US006152982A

United States Patent [19]

Froes et al.

[11] Patent Number: 6,152,982

[45] Date of Patent: Nov. 28, 2000

[54] REDUCTION OF METAL OXIDES THROUGH MECHANOCHEMICAL PROCESSING

[75] Inventors: Francis H. Froes; Baburaj G. Eranezhuth; Oleg N. Senkov, all of Moscow, Id.

[73] Assignee: Idaho Research Foundation, Inc., Moscow, Id.

[21] Appl. No.: 09/248,200

[22] Filed: Feb. 10, 1999

Related U.S. Application Data

[60] Provisional application No. 60/074,693, Feb. 13, 1998.

[51] Int. Cl.[7] ..... B22F 1/00

[52] U.S. Cl. ..... 75/343; 75/359; 75/369

[58] Field of Search ..... 75/343, 359, 369, 75/354, 350

[56] References Cited

U.S. PATENT DOCUMENTS

| | | | |
|---|---|---|---|
| 2,038,402 | 4/1936 | Alexander . | |
| 2,273,834 | 2/1942 | Comstock et al. . | |
| 3,625,779 | 12/1971 | Cech . | |
| 3,748,193 | 7/1973 | Cech et al. . | |
| 3,918,933 | 11/1975 | Martin . | |
| 4,318,734 | 3/1982 | Scott et al. . | |
| 4,681,623 | 7/1987 | Okajima et al. . | |
| 5,328,501 | 7/1994 | McCormick et al. | 75/352 |

OTHER PUBLICATIONS

Baburaj, E.G. et al; Production of Low Cost Titanium; Non–Aerosp. Appl. Titanium, Proc. Symp. (1998), 89–97, 1998.

*Primary Examiner*—Ngoclan Mai
*Attorney, Agent, or Firm*—Ormiston & McKinney, PLLC

[57] ABSTRACT

The low temperature reduction of a metal oxide using mechanochemical processing techniques. The reduction reactions are induced mechanically by milling the reactants. In one embodiment of the invention, titanium oxide $TiO_2$ is milled with $CaH_2$ to produce $TiH_2$. Low temperature heat treating, in the range of 400° C. to 700° C., can be used to remove the hydrogen in the titanium hydride.

13 Claims, 1 Drawing Sheet

REDUCTION OF METAL OXIDES THROUGH MECHANOCHEMICAL PROCESSING

CROSS REFERENCE TO RELATED APPLICATIONS

This application claims subject matter disclosed in the co-pending provisional application Ser. No. 60/074,693 filed Feb. 13, 1998, which is incorporated herein in its entirety.

This invention was funded in part by the United States Department of Energy under Subcontract No. CCS-588176 under Subcontract No. LITCO-C95-175002 under Prime Contract No. DE-AC07-94ID13223 and Subcontract No. 323120-A-U4 under Prime Contract No. DE-AC06-76RLO 1830. The United States government has certain rights in the invention.

FIELD OF THE INVENTION

The invention relates generally to powder metallurgy and, more particularly, to the application of mechanical alloying techniques to chemical refining through sold state reactions.

BACKGROUND OF THE INVENTION

Mechanical alloying is a powder metallurgy process consisting of repeatedly welding, fracturing and rewelding powder particles through high energy mechanical milling. Mechanochemical processing is the application of mechanical alloying techniques to induce chemical reactions and chemical refinement processes through sold state reactions. The energy of impact of the milling media, the balls in a ball mill for example, on the reactants is effectively substituted for high temperature so that solid state reactions can be carried out at room temperature.

Titanium and its alloys are attractive materials for use in aerospace and terrestrial systems. There are impediments, however, to wide spread use of titanium based materials in, for example, the cost conscious automobile industry. The titanium based materials that are commercially available now and conventional techniques for fabricating components that use these materials are very expensive. Titanium powder metallurgy offers a cost effective alternative for the manufacture of titanium components if low cost titanium powder and titanium alloy powders were available. The use of titanium and its alloys will increase significantly if they can be inexpensively produced in powder form.

Currently, titanium powder and titanium alloy powders are produced by reducing titanium chloride to titanium through the Kroll or Hunter processes and hydrogenating, crushing and dehydrogenating the resulting ingot material (the HDH process). The cost of production by these processes, particularly the HDH process, is much higher than is desirable for most commercial uses of titanium powders. In the case of titanium alloy powders, especially multi-component alloys and intermetallics, the cost of HDH production escalates because the alloys must generally be melted and homogenized prior to HDH processing.

Conventional methods for producing titanium by reducing titanium chloride is a multi-step process. In the first step, titanium ore in the form of titanium oxide $TiO_2$ is chlorinated to form $TiCl_4$, as shown in Eq. 1.

$$TiO_2+2Cl_2(\text{in the presence of carbon at high temperature})\rightarrow TiCl_4 \quad (1)$$

Then, as shown in Eq. 2, the titanium chloride is reduced by magnesium or sodium at high temperature, above 800° C., to form titanium.

$$TiCl_4+2Mg\rightarrow Ti+2MgCl_2 \quad (2)$$

Titanium is tightly bonded to oxygen. This factor in conjunction with the high temperature chlorination and reduction processes lead to high cost. Additionally, the sponge/fines products contain salts (NaCl or $MgCl_2$, depending on the specific process used). These chloride salts are leached out to obtain sponge Ti with chloride salt contamination levels of about 1500 ppm. Even with intense leaching/vacuum distillation, remnant salt remains at a level of 150 ppm and above. The remnant salt can be removed by the ingot melting step in the HDH process. Leaving remnant salt in the powder degrades the mechanical properties of the titanium, particularly those properties such as fatigue (S-N) that are initiation related. For use in high integrity applications a salt free powder is needed. For less demanding applications, a minimization of the cost of the powder is required. Presently, manufacturers must choose between low cost sponge fines which lead to inferior properties or high priced powders.

Commercial pure titanium powders with chloride salt levels less than 10 ppm can be obtained by crushing hydrogenated ingot material followed by dehydrogenation (HDH) or by reacting $TiO_2$ with fluorine salts and then reducing the fluorinated titanium with aluminum. As noted above, the HDH process is prohibitively expensive for most commercial uses of titanium. A number of attempts have been made in the past to reduce the cost of producing titanium sponge. These include continuous injection of titanium chloride into a molten alloy system consisting of titanium, zinc and magnesium, vapor phase reduction and aerosol reduction. Although cost reductions as high as 40% have been estimated for some of these techniques, a common feature of all of these processes is the use of high temperatures to reduce titanium chloride or titanium oxide. The direct reduction of $TiO_2$ is being considered as one way to reduce the cost of producing of titanium. So far as the Applicants are aware, the only method for the direct reduction of the oxide presently available is a Russian process of metal hydride reduction (MHR) at a high temperature, about 1100° C. The reduction reaction between titanium oxide and calcium hydride is shown in Eq. 3.

$$TiO_2+2CaH_2\rightarrow Ti+2CaO+2H_2 \quad (3)$$

The Russian process produces chloride free Ti powder in a single step reaction. Eq. 3 also shows the possibility of forming $TiH_2$ if the reaction can be carried out at lower temperatures where $TiH_2$ is stable.

SUMMARY OF THE INVENTION

The present invention is directed to the low temperature reduction of a metal oxide using mechanochemical processing techniques. The reduction reactions are induced mechanically by milling the reactants. In one embodiment of the invention, titanium oxide $TiO_2$ is milled with $CaH_2$ to produce $TiH_2$. Low temperature heat treating, in the range of about 400° C. to about 700° C., may be used to complete the reduction to $TiH_2$ and remove the hydrogen in the titanium hydride.

DETAILED DESCRIPTION OF THE INVENTION

Figure 1:
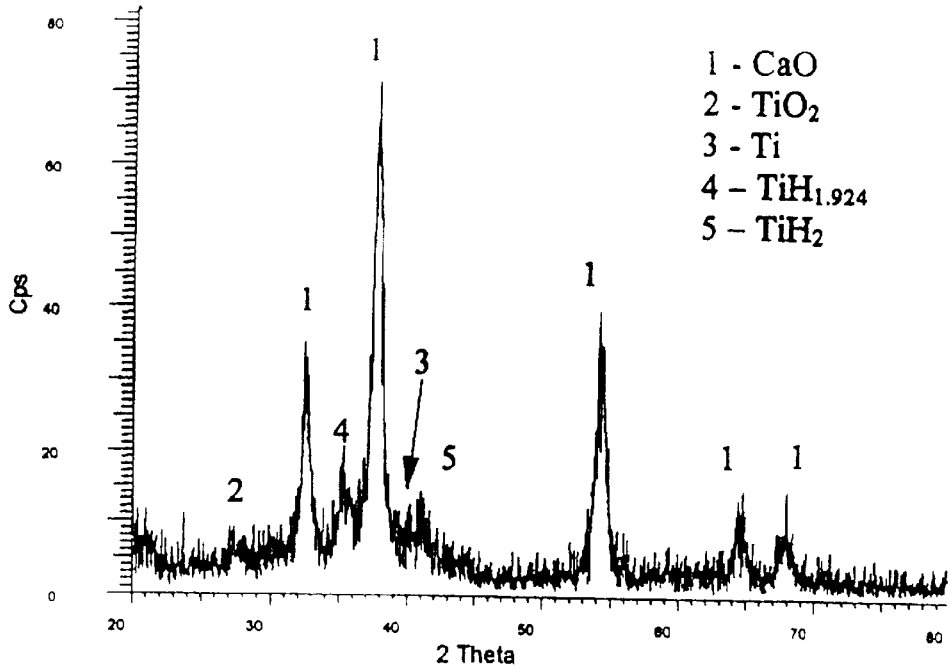
FIG. 1 shows the XRD patterns for reaction products heat treated up to 450° C. after milling for four hours.

"Milling" as used in this Specification and in the Claims means mechanical milling in a ball mill, attrition mill, shaker mill, rod mill, or any other suitable milling device. "Metal powder" as used in this Specification and in the Claims includes all forms of metal and metal based reaction products, specifically including but not limited to elemental metal powders, metal hydride powders, metal alloy powders and metal alloy hydride powders.

Fundamentals of Mechanochemical Processing Techniques

A solid state reaction, once initiated, will be sustaining if the heat of reaction is sufficiently high. It has been shown recently that the conditions required for the occurrence of reduction-diffusion and combustion synthesis reactions can be simultaneously achieved by mechanically alloying the reactants. Mechanical alloying is a powder metallurgy process consisting of repeatedly welding, fracturing and rewelding powder particles through high energy mechanical milling. Mechanochemical processing is the application of mechanical alloying techniques to induce chemical reactions and chemical refinement processes through sold state reactions. The energy of impact of the milling media, the balls in a ball mill for example, on the reactants is substituted for high temperature so that solid state reactions can be carried out at room temperature. In recent experiments, a number of nanocrystalline metal and alloy powders have been prepared through solid state reactions employing mechanical alloying.

The chemical kinetics of solid state reactions are determined by diffusion rates of reactants through the product phases. Hence, the activation energy for the reaction is the same as that for the diffusion. The reaction is controlled by the factors which influence diffusion rates. These factors include the defect structure of reactants and the local temperature. Both of these factors are influenced by the fracture and welding of powder particles during milling when unreacted materials come into contact with other material. Milling causes highly exothermic reactions to proceed by the propagation of a combustion wave through unreacted powder. This is analogous to self propagating high temperature synthesis.

Mechanochemical processing is advantageous because the reduction reactions, which are normally carried out at high temperatures, can be achieved at lower temperatures. Fine powder reaction products can be formed by mechanochemical processing. Hence, this technique provides a viable option for the production of nanocrystalline materials. In the present invention, mechanical forces are used to induce the reduction chemical reaction at low temperatures.

Reduction Of $TiO_2$ Through Mechanochemical Processing

The calcium hydride $CaH_2$ used in the examples described below were 99.8% pure and had a particle size of −325 mesh. The mechanical milling of $TiO_2$ with CaH2 was carried out in a Spex 8000 mixer mill using hardened steel vials and 4.5 mm diameter balls. A 40:1 to 50:1 mass ratio of balls to reactants was employed in all examples. The vials may be made of titanium to minimize corrosion and contamination. The vials were loaded and sealed and the powder was handled inside an argon filled glove box.

The reactants were taken in the mole ratio of 1:2, as shown in Eqs. 3 and 4. Experiments involving milling from 1 to 72 hours were carried out to test the feasibility of the reaction between the titanium oxide and calcium hydride. The milled powders were examined by XRD. The first set of experiments showed only limited conversion of the titanium oxide to titanium hydride, according to the reduction reaction represented in Eq. 4, which indicated the necessity of heating the reactants to enhance the reaction rate.

$$TiO_2+2CaH_2 \rightarrow TiH_2+2CaO+H_2 \quad (4)$$

Since heating the milling vial during processing can be difficult, an alternate internal heating was introduced through the reaction of $TiCl_4$ with $CaH_2$. For this purpose, $TiCl_4$ was milled along with $TiO_2$ and $CaH_2$. It was expected that the enthalpy of reaction between the $TiCl_4$ and $CaH_2$ would further enhance the reaction between the oxide and hydride. However, the XRD examination of the products showed the presence of $TiO_2$ which indicated that the reaction could not be fully completed using this technique.

Further experiments were carried out through a combination of milling and heat treatment. The heat treatment temperatures were evaluated on the basis of Differential Thermal Analysis (DTA) of the milled products. Based on the temperatures for the different thermal events found in the thermogram, samples were obtained after different levels of heating in the DTA. FIG. 1 is the XRD pattern corresponding to reaction products milled for four hours, heat treated in DTA up to 450° C. and then cooled. The pattern shows the presence of $TiH_2$ and along with a small amount of Ti. The low temperature of the reduction reaction results in the formation of stable hydrided powder. Calcium oxide CaO was leached out with a 5–10% solution of formic acid. Due to the poor reactivity of the hydrided Ti, leaching the heat treated powder to remove the reaction product CaO does not cause the oxidation of the fine powder.

Figure 2:
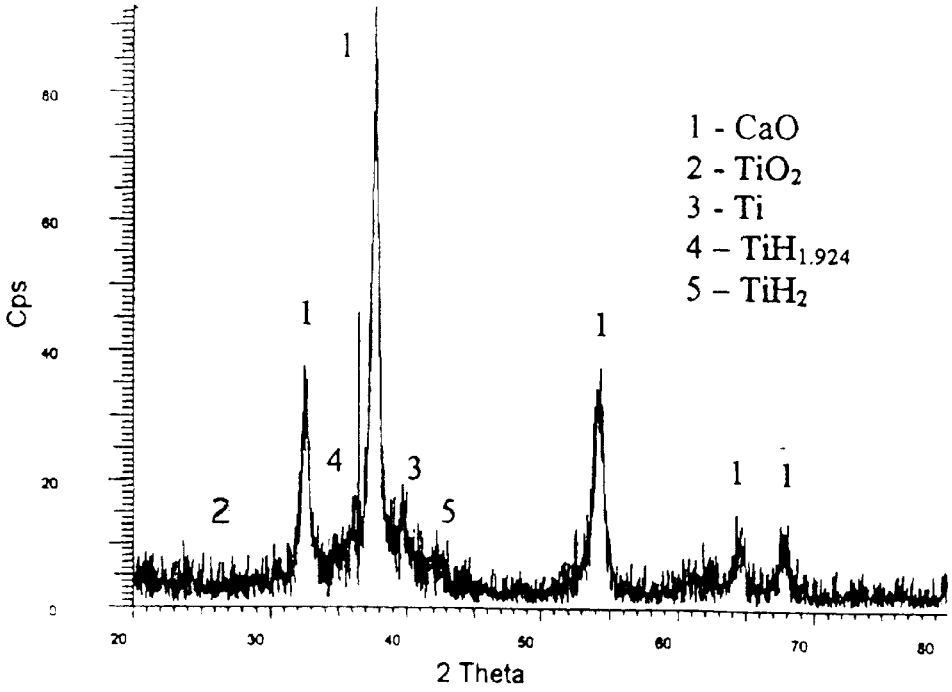
FIG. 2 shows the XRD patterns for reaction products heat treated up to 600° C. after the lower temperature treatment at 450° C.

After the 450° C. heat treatment, the powder was heated to 600° C. and held for 3 minutes in the DTA. The XRD pattern of the reaction products for this higher temperature heat treatment, seen in FIG. 2, shows the decomposition of $TiH_2$ to Ti. The titanium hydride peaks for the lower heat treatment, marked as 4 and 5 in FIG. 1, are higher than the titanium hydride peaks for the higher heat treatment, marked as 4 and 5 in FIG. 2. The higher heat treatment temperature of 600° C. results in the development of the Ti peak at the expense of the $TiH_2$ peaks. These results suggest that it is possible to control the reaction product by controlling the heat treatment temperatures. It is expected that heat treatment at temperatures in the range of 400° C. to 700° C., preferably under vacuum, will be effective to complete the reduction of the titanium oxide to titanium hydride or titanium.

The hydrided powder, which may be produced using lower heat treatment temperatures is more passive to oxidation than the elemental Ti powder. This aspect of the invention can be exploited to minimize the oxidation of the powder during leaching. The hydrogen in the titanium hydride can be removed during heat treatments and sintering in manufacturing for consolidation of the powder into solid objects such as sheets, tubes and the like.

The invention has been shown and described with reference to the production of titanium Ti in the foregoing embodiments. It will be understood, however, that the invention may be used in these and other embodiments to produce other metals or alloys. It is expected that the invented process may be used effectively to produce metal powders for most or all of the metals of Groups III, IV and V of the Periodic table. Also, it is expected that magnesium hydride, for example, as well as other reactive metals and metal hydrides such as calcium, lithium, sodium, scandium and aluminum may be used effectively as a reducing agent. Therefore, the embodiments of the invention shown and described may be modified or varied without departing from the scope of the invention, which is set forth in the following claims.

What is claimed is:

1. A process for producing a metal powder, comprising mechanically inducing a reduction reaction between titanium oxide $TiO_2$ and a metal hydride.

2. A process for producing a metal powder, comprising mechanically inducing a reduction reaction between a reducible metal oxide and calcium hydride $CaH_2$.

3. A process for producing a titanium powder, comprising milling titanium oxide $TiO_2$ and calcium hydride $CaH_2$.

4. A process for producing a titanium powder, comprising milling titanium oxide $TiO_2$ and calcium hydride $CaH_2$ to form $TiH_2$ and then heat treating the $TiH_2$.

5. The process according to claim 4, wherein the $TiH_2$ is heated to a temperature between 400° C. and 700° C.

6. A process for producing a titanium powder, comprising mechanically inducing the reaction $TiO_2+2CaH_2 \rightarrow Ti+2CaO+2H_2$.

7. The process according to claim 6, wherein the reaction is induced by milling titanium oxide $TiO_2$ and calcium hydride $CaH_2$.

8. The process according to claim 6, further comprising removing calcium oxide CaO from the reaction products.

9. A process for producing a titanium powder, comprising mechanically inducing the reaction $TiO_2+2CaH_2 \rightarrow TiH_2+2CaO+H_2$.

10. The process according to claim 9, wherein the reaction is induced by milling titanium oxide $TiO_2$ and calcium hydride $CaH_2$.

11. The process according to claim 9, further comprising dehydriding titanium hydride $TiH_2$.

12. The process according to claim 11, further comprising heating the titanium hydride $TiH_2$ to a temperature in the range of 400° C. to about 700° C.

13. The process according to claim 9, further comprising removing calcium oxide CaO from the reaction products.

* * * * *